US009057184B2

(12) United States Patent
Meehan et al.

(10) Patent No.: US 9,057,184 B2
(45) Date of Patent: Jun. 16, 2015

(54) INSULATOR BASE FOR ELECTRONIC FAUCET

(75) Inventors: Steven Kyle Meehan, Fishers, IN (US); Nathan Emil Theiring, Newburgh, IN (US); Rick Darrel Anderson, Henderson, KY (US); Joseph Chad Shields, Morgantown, KY (US); Hongjing Liang, Guangzhou (CN)

(73) Assignee: Delta Faucet Company, Indianapolis, IN (US)

( * ) Notice: Subject to any disclaimer, the term of this patent is extended or adjusted under 35 U.S.C. 154(b) by 868 days.

(21) Appl. No.: 13/277,000

(22) Filed: Oct. 19, 2011

(65) Prior Publication Data

US 2013/0098489 A1 Apr. 25, 2013

(51) Int. Cl.

| | |
|---|---|
| ***E03C 1/05*** | (2006.01) |
| ***E03C 1/04*** | (2006.01) |
| ***F21V 33/00*** | (2006.01) |

(52) U.S. Cl.

CPC ..... *E03C 1/057* (2013.01); *Y10T 29/49124* (2015.01); *E03C 1/0401* (2013.01); *E03C 1/0404* (2013.01); *F21V 33/004* (2013.01)

(58) Field of Classification Search

CPC ..... E03C 1/0401; E03C 1/0404; E03C 1/057
USPC ..... 4/623, 695; 137/359, 801; 251/129.01, 251/129.04

See application file for complete search history.

(56) References Cited

U.S. PATENT DOCUMENTS

| | | | | |
|---|---|---|---|---|
| 3,904,169 | A * | 9/1975 | Cohn et al. | 251/86 |
| 3,998,240 | A | 12/1976 | Liautaud | |
| 4,037,624 | A | 7/1977 | Turner et al. | |
| 4,186,761 | A | 2/1980 | Guarnieri | |
| 4,353,056 | A | 10/1982 | Tsikos | |
| 4,623,451 | A | 11/1986 | Oliver | |
| 4,667,987 | A | 5/1987 | Knebel | |
| 4,749,126 | A | 6/1988 | Kessener | |
| 4,762,611 | A | 8/1988 | Schipper | |
| 4,849,098 | A | 7/1989 | Wilcock et al. | |
| 4,901,922 | A | 2/1990 | Kessener | |
| 4,915,347 | A | 4/1990 | Iqbal et al. | |
| 4,955,535 | A | 9/1990 | Tsutsui et al. | |
| 4,998,673 | A | 3/1991 | Pilolla | |
| 5,126,041 | A | 6/1992 | Weber | |
| 5,171,429 | A | 12/1992 | Yasuo | |
| 5,220,488 | A | 6/1993 | Denes | |
| 5,224,509 | A | 7/1993 | Tanaka et al. | |

(Continued)

FOREIGN PATENT DOCUMENTS

| | | |
|---|---|---|
| CN | 201250949 Y | 6/2009 |
| CN | 201496622 | 6/2010 |

(Continued)

OTHER PUBLICATIONS

Chicago Faucets brochure, "Electronic Faucets," dated Jun. 2008, 16 pgs.

MOEN PureTouch Illustrated Parts, Available at Least as Early as 2003, 1 page.

(Continued)

*Primary Examiner* — Kevin Murphy
(74) *Attorney, Agent, or Firm* — Faegre Baker Daniels LLP

(57) ABSTRACT

An insulator base for an electronic faucet includes a housing supporting a light assembly and a connecting wire electrically coupled to the light assembly. A polymer overmold is coupled to the housing and secures the light assembly and the connecting wire within the housing.

21 Claims, 7 Drawing Sheets

(56) References Cited

U.S. PATENT DOCUMENTS

| | | | | |
|---|---|---|---|---|
| 5,232,008 | A | 8/1993 | Jeffries et al. | |
| 5,276,600 | A | 1/1994 | Takase et al. | |
| 5,388,287 | A | 2/1995 | Tischler et al. | |
| 5,458,154 | A | 10/1995 | Niemann et al. | |
| 5,566,702 | A | 10/1996 | Philipp | |
| 5,669,417 | A | 9/1997 | Lian-Jie | |
| 5,758,688 | A | 6/1998 | Hamanaka et al. | |
| 5,873,387 | A | 2/1999 | Weber et al. | |
| 5,942,733 | A | 8/1999 | Allen et al. | |
| 6,014,985 | A | 1/2000 | Warshawsky | |
| 6,021,960 | A | 2/2000 | Kehat | |
| 6,082,407 | A | 7/2000 | Paterson et al. | |
| 6,126,290 | A | 10/2000 | Veigel | |
| 6,192,530 | B1 | 2/2001 | Dai | |
| 6,202,980 | B1 | 3/2001 | Vincent et al. | |
| 6,209,153 | B1 | 4/2001 | Segien, Jr. | |
| 6,294,786 | B1 | 9/2001 | Marcichow et al. | |
| 6,370,712 | B1 | 4/2002 | Burns et al. | |
| 6,370,965 | B1 | 4/2002 | Knapp | |
| 6,382,030 | B1 | 5/2002 | Kihara et al. | |
| 6,385,794 | B1 | 5/2002 | Miedzius et al. | |
| 6,385,798 | B1 | 5/2002 | Burns et al. | |
| 6,434,765 | B1 | 8/2002 | Burns et al. | |
| 6,452,514 | B1 | 9/2002 | Philipp | |
| 6,513,787 | B1 | 2/2003 | Jeromson et al. | |
| 6,523,193 | B2 | 2/2003 | Saraya | |
| 6,548,192 | B2 | 4/2003 | Chen | |
| 6,548,193 | B2 | 4/2003 | Chen | |
| 6,551,722 | B2 | 4/2003 | Jonte et al. | |
| 6,558,816 | B2 | 5/2003 | Chen | |
| 6,619,320 | B2 | 9/2003 | Parsons | |
| 6,659,124 | B2 | 12/2003 | Burns et al. | |
| 6,716,345 | B2 | 4/2004 | Snyder | |
| 6,729,349 | B2 | 5/2004 | Brandebusemeyer | |
| 6,734,685 | B2 | 5/2004 | Rudrich | |
| 6,757,921 | B2 | 7/2004 | Esche | |
| 6,764,775 | B2 | 7/2004 | Chen | |
| 6,770,376 | B2 | 8/2004 | Chen | |
| 6,770,384 | B2 | 8/2004 | Chen | |
| 6,792,629 | B2 | 9/2004 | Nelson et al. | |
| 6,803,133 | B2 | 10/2004 | Chen | |
| 6,805,458 | B2 | 10/2004 | Schindler et al. | |
| 6,874,527 | B2 | 4/2005 | Meeder | |
| 6,909,101 | B2 | 6/2005 | Nishioka | |
| 6,962,168 | B2 | 11/2005 | McDaniel et al. | |
| 6,964,404 | B2 * | 11/2005 | Patterson et al. | 251/129.04 |
| 7,008,073 | B2 | 3/2006 | Stuhlmacher, II | |
| 7,017,600 | B2 | 3/2006 | Klein | |
| 7,104,519 | B2 | 9/2006 | O'Maley et al. | |
| 7,150,293 | B2 | 12/2006 | Jonte | |
| 7,174,577 | B2 | 2/2007 | Jost et al. | |
| 7,175,158 | B2 | 2/2007 | Thomas | |
| 7,201,175 | B2 | 4/2007 | DeBoer et al. | |
| 7,228,874 | B2 | 6/2007 | Bolderheij et al. | |
| 7,258,781 | B2 | 8/2007 | Warren et al. | |
| 7,344,902 | B2 | 3/2008 | Basin et al. | |
| 7,377,661 | B2 | 5/2008 | Douglass | |
| 7,406,980 | B2 | 8/2008 | Pinette | |
| 7,415,991 | B2 | 8/2008 | Meehan et al. | |
| 7,434,960 | B2 | 10/2008 | Stuhlmacher, II | |
| 7,464,418 | B2 | 12/2008 | Seggio et al. | |
| 7,467,874 | B2 | 12/2008 | Gautschi et al. | |
| 7,518,381 | B2 | 4/2009 | Lamborghini et al. | |
| 7,537,023 | B2 | 5/2009 | Marty et al. | |
| 7,624,757 | B2 | 12/2009 | Schmitt et al. | |
| 7,627,909 | B2 | 12/2009 | Esche | |
| 7,628,512 | B2 | 12/2009 | Netzel, Sr. et al. | |
| 7,631,372 | B2 | 12/2009 | Marty et al. | |
| 7,633,055 | B2 | 12/2009 | Nall et al. | |
| 7,666,497 | B2 | 2/2010 | Takatsuki et al. | |
| 7,690,395 | B2 | 4/2010 | Jonte et al. | |
| 7,717,133 | B2 | 5/2010 | Pinette et al. | |
| 7,721,761 | B2 | 5/2010 | Thomas | |
| 7,748,409 | B2 | 7/2010 | Pinette et al. | |
| 7,766,043 | B2 | 8/2010 | Thomas et al. | |
| 7,793,677 | B2 | 9/2010 | Pinette | |
| 7,806,141 | B2 | 10/2010 | Marty et al. | |
| 7,819,137 | B2 | 10/2010 | Nelson et al. | |
| 7,819,541 | B2 | 10/2010 | Kunkel | |
| 7,850,323 | B2 | 12/2010 | Keiper et al. | |
| 7,883,261 | B2 | 2/2011 | Yu | |
| 7,896,025 | B2 | 3/2011 | Hanson | |
| 8,127,782 | B2 | 3/2012 | Jonte et al. | |
| 8,162,236 | B2 | 4/2012 | Rodenbeck et al. | |
| 8,198,979 | B2 | 6/2012 | Haag et al. | |
| 8,277,070 | B1 | 10/2012 | Schwarz | |
| 8,438,672 | B2 | 5/2013 | Reeder et al. | |
| 8,453,669 | B2 | 6/2013 | Veros et al. | |
| 2002/0150798 | A1 | 10/2002 | Jonte et al. | |
| 2003/0213062 | A1 | 11/2003 | Honda et al. | |
| 2004/0179351 | A1 | 9/2004 | Patterson | |
| 2005/0257628 | A1 | 11/2005 | Nikaido et al. | |
| 2005/0279676 | A1 | 12/2005 | Izzy et al. | |
| 2006/0124183 | A1 | 6/2006 | Kuo | |
| 2006/0157127 | A1 | 7/2006 | Bars et al. | |
| 2006/0157128 | A1 | 7/2006 | Frackowiak et al. | |
| 2006/0283511 | A1 | 12/2006 | Nelson | |
| 2006/0289343 | A1 | 12/2006 | Schmitt et al. | |
| 2007/0031624 | A1 | 2/2007 | Brosius | |
| 2007/0069418 | A1 | 3/2007 | Liao et al. | |
| 2007/0121326 | A1 | 5/2007 | Nall et al. | |
| 2007/0137714 | A1 | 6/2007 | Meehan et al. | |
| 2007/0241977 | A1 | 10/2007 | Vance | |
| 2007/0273394 | A1 | 11/2007 | Tanner et al. | |
| 2008/0099091 | A1 | 5/2008 | Benstead | |
| 2008/0109956 | A1 | 5/2008 | Bayley et al. | |
| 2008/0178935 | A1 | 7/2008 | Thomas | |
| 2008/0178942 | A1 * | 7/2008 | Pinette et al. | 137/377 |
| 2008/0178954 | A1 | 7/2008 | Pinette et al. | |
| 2008/0185060 | A1 | 8/2008 | Nelson | |
| 2008/0257706 | A1 | 10/2008 | Haag | |
| 2008/0291660 | A1 | 11/2008 | Gautschi et al. | |
| 2008/0308165 | A1 | 12/2008 | Meehan et al. | |
| 2009/0000026 | A1 | 1/2009 | Hanson | |
| 2009/0039176 | A1 | 2/2009 | Davidson et al. | |
| 2009/0094740 | A1 * | 4/2009 | Ji | 4/623 |
| 2009/0154524 | A1 | 6/2009 | Girelli | |
| 2009/0276954 | A1 | 11/2009 | Davidson | |
| 2010/0117660 | A1 | 5/2010 | Douglas et al. | |
| 2010/0180375 | A1 | 7/2010 | Meehan et al. | |
| 2010/0242274 | A1 | 9/2010 | Rosenfeld et al. | |
| 2011/0003144 | A1 | 1/2011 | Nakamura et al. | |
| 2011/0012378 | A1 | 1/2011 | Ueno et al. | |
| 2011/0016625 | A1 | 1/2011 | Marty et al. | |
| 2011/0187957 | A1 | 8/2011 | Kim et al. | |
| 2011/0209781 | A1 | 9/2011 | Fath | |
| 2012/0055886 | A1 | 3/2012 | Hunter et al. | |
| 2012/0188179 | A1 | 7/2012 | Karlsson | |
| 2012/0200517 | A1 | 8/2012 | Nikolovski | |
| 2012/0223805 | A1 | 9/2012 | Haag et al. | |
| 2012/0267493 | A1 | 10/2012 | Meehan et al. | |
| 2013/0098489 | A1 | 4/2013 | Meehan et al. | |
| 2013/0186482 | A1 | 7/2013 | Veros et al. | |

FOREIGN PATENT DOCUMENTS

| | | |
|---|---|---|
| CN | 201875209 | 6/2011 |
| JP | 2001120448 | 5/2001 |
| JP | 2002242246 | 8/2002 |
| JP | 2003232059 | 8/2003 |
| JP | 2004116083 A | 4/2004 |
| WO | WO2006/098795 | 9/2006 |
| WO | WO 2007/059051 | 5/2007 |
| WO | WO2007/123639 | 11/2007 |
| WO | WO 2008/088534 | 7/2008 |
| WO | WO 2009/158498 | 12/2009 |
| WO | WO 2010/120070 | 10/2010 |

OTHER PUBLICATIONS

Dave Van Ess, Capacitive Sensing Builds a Better Water-Cooler Control, Cypress Semiconductor Corp. Nov. 2007, 9 pages.

Aviation Faucet System, Product Brochure, Franke Aquarotter GmbH, downloaded Oct. 1, 2012, 6 pages.

(56) References Cited

OTHER PUBLICATIONS

Springking Industry Col, Limited, Touch Sensor Faucet, Product Specification, downloaded Oct. 1, 2012.
MOEN PureTouch Owner's Manual INS412A, Available at Least as Early as 2003, 18 pages.
MOEN, Single Handle Filtering Faucet, INS1169-4/06, 6 pages, dated Apr. 2006.
Wavelock Advanced Technology Co., Ltd, Introducing Wavelock Advanced Technorogy's Decorative Metallic Tape and Sheet, 18 pages, available at least as early as Nov. 2012.
Sloan Valve Company, Optima Plus EBF-750 product description, dated Feb. 2011, 2 pages.
Sloan Valve Company, Installation Instructions and User Manual for SLOAN EAF Gooseneck Series Faucets, Code No. 0816409, dated Jul. 2011, 10 pages.
Grohe, Europlus E "Touch-Free" Centerset Product Catalog, downloaded from http://www.grohecatalog.com/print/36212 Nov. 6, 2013, 3 pages.
Photograph of "Current Parts," 1 page, available at least as early as Oct. 2010.

* cited by examiner

INSULATOR BASE FOR ELECTRONIC FAUCET

BACKGROUND AND SUMMARY OF THE INVENTION

The present invention relates to the field of electronic faucets and, more particularly, to an insulator base for an electronic kitchen faucet.

Automatic or electronic faucets, such as those including capacitive control or sensing features, are becoming increasingly popular, particularly in residential households. Such faucets tend to be at least partially formed of metal or other electrically conductive material. Capacitive sensing faucets may be mounted to a mounting deck, such as a kitchen sink, that may be made of metal, such as stainless steel. In such instances, an electrically non-conductive mounting assembly may be used to insulate the metal capacitive sensing components of the faucet from the metal sink.

One such non-conductive mounting assembly may include an insulator base positioned intermediate a faucet delivery spout and a mounting deck. A light emitter may be supported within the insulator base for providing a visual indication of faucet operation to the user. In such instances, it is desired to protect the light emitter and associated circuitry from exposure to water, which may adversely affect the performance of the electronic faucet.

According to an illustrative embodiment of the present disclosure, an insulator base for an electronic faucet includes a housing having an outer sidewall extending about an opening defining a longitudinal axis, a receiving chamber positioned inwardly from the outer sidewall, a channel positioned inwardly from the outer sidewall and in communication with the receiving chamber, and an aperture formed within the outer sidewall and in communication with the receiving chamber. A light assembly includes a light emitter coupled to the support board. The support board is positioned within the receiving chamber of the housing. A connecting wire is electrically coupled to the light assembly, and extends within the channel of the base and into the receiving chamber. A polymer overmold is coupled to the housing and secures the light assembly within the receiving chamber and the electrical wire within the channel. The overmold defines a lens within the aperture of the outer sidewall, the lens permitting the transmission of light from the light emitter therethrough.

According to another illustrative embodiment of the present disclosure, an insulator base for an electronic faucet includes a housing having an outer sidewall, an inner sidewall, a channel defined between the outer sidewall and the inner sidewall, a receiving chamber positioned adjacent the channel, and an aperture formed within the outer sidewall and in communication with the receiving chamber. A light assembly includes a support board and a light emitter coupled to the board. The support board is received within the receiving chamber of the base. A connecting wire is electrically coupled to the light assembly, and extends within the channel of the base. A polymer overmold is coupled to the housing, the overmold securing the connecting wire within the channel, encapsulating the light assembly within the chamber, and defining a lens within the aperture of the outer sidewall. The lens permits the transmission of light from the light emitter therethrough. The polymer overmold further defines a downwardly extending sealing member for sealing with a mounting deck.

According to a further illustrative embodiment of the present disclosure, an electronic faucet includes a delivery spout, a water conduit extending within the delivery spout and having a water outlet, and a base positioned intermediate the delivery spout and the mounting deck. The base includes a housing defining an opening receiving the water conduit, a light assembly supported by the housing and having a light emitter, and an overmold insert molded within the housing and encapsulating the light assembly. A controller is operably coupled to the light assembly, and is configured to control operation of the light emitter.

According to yet another illustrative embodiment of the present disclosure, a method of manufacturing an insulator base for an electronic faucet includes the steps of molding a polymer housing, placing a light assembly within a chamber of the housing, the light assembly including a light emitter, and placing a connecting wire within a receiving channel of the housing. The method further includes the step of insert molding a polymer overmold within the chamber of the housing and the receiving channel of the housing, the overmold encapsulating the light assembly and retaining the connecting wire within the housing.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
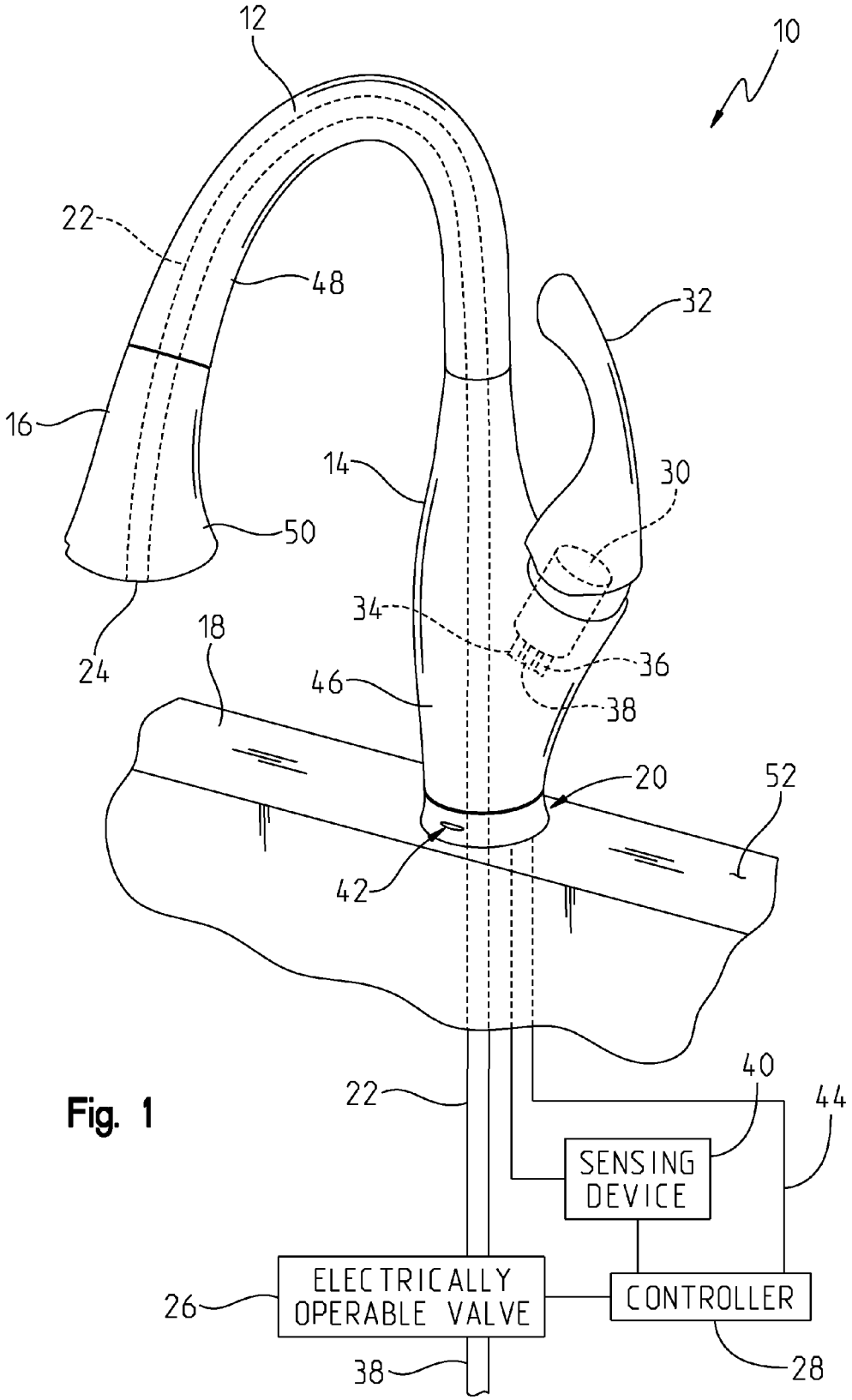
FIG. 1 is a perspective view of an illustrative electronic faucet including an insulator base of the present disclosure positioned intermediate a delivery spout and a mounting deck.
Figure 2:
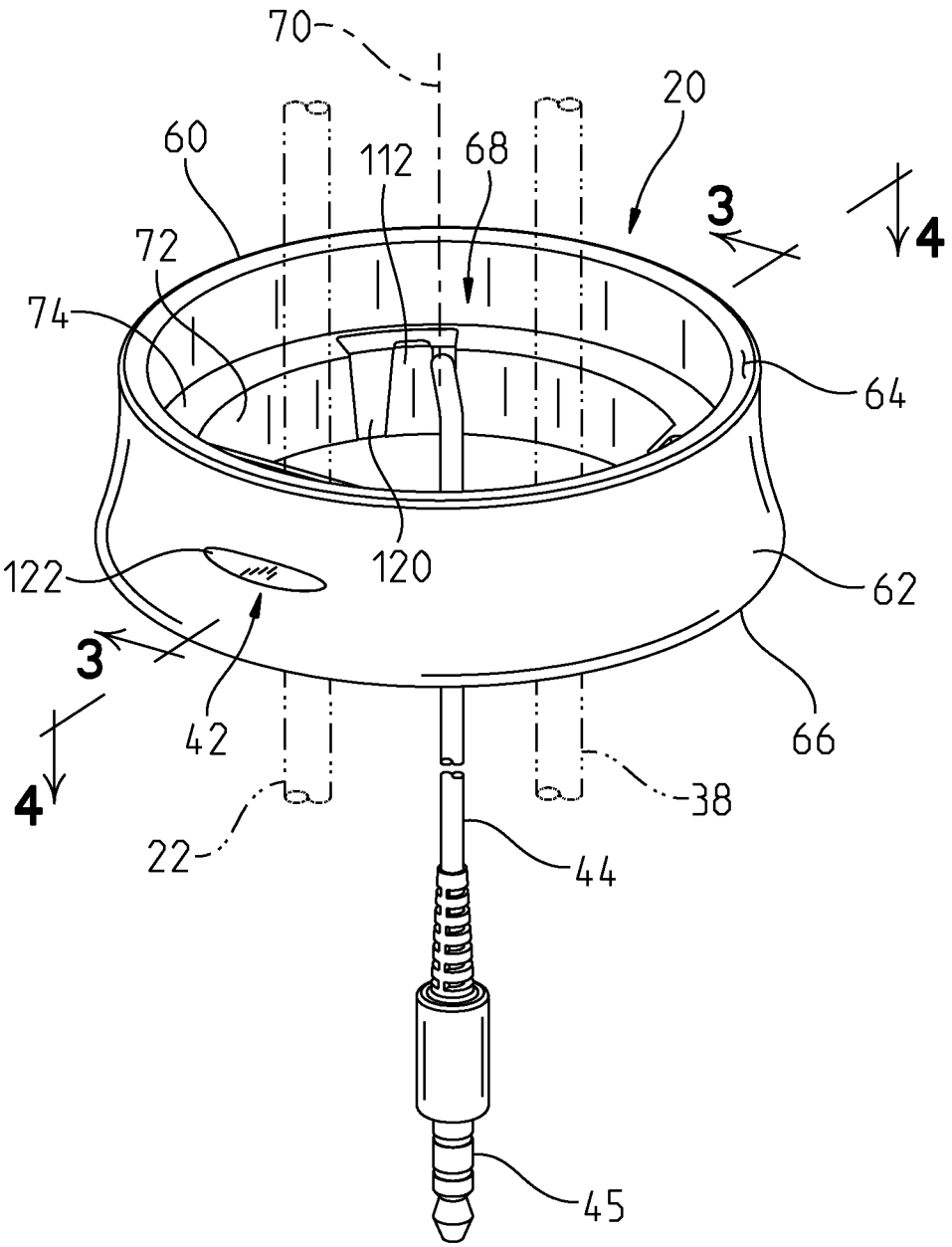
FIG. 2 is a perspective view of the insulator base of FIG. 1.

Referring initially to FIG. 1, an illustrative electronic faucet 10 is shown as including a delivery spout 12 supported by a hub 14. A removable spray head 16 may be releasably coupled to the delivery spout 12 in a conventional manner. The faucet 10 is coupled to a mounting deck 18, such as a sink deck, through a known fastener or anchor (not shown). The hub 14 is illustratively positioned above the mounting deck 18 by an insulator base 20 of the present disclosure.

In the illustrative embodiment, a flexible fluid conduit or tube 22 extends from below the sink deck 18 through the insulator base 20, upwardly through the hub 14 and delivery spout 12 to a fluid outlet 24 supported by the spray head 16. An electrically operable valve 26 illustratively controls water flow through the conduit 22 to the outlet 24. The electrically operable valve 26 is in communication with a controller 28 which is configured to open and close the electrically operable valve 26 to control water flow through the conduit 22 and outlet 24. A power source, such as a battery (not shown), may provide electrical power to the controller 28 and the electrically operable valve 26.

In certain illustrative embodiments, a manual valve 30 may be positioned upstream from, and fluidly coupled in series with, the electrically operable valve 26. The manually operable valve 30 is illustratively operably coupled to a handle 32 supported on a side of the hub 14. Hot and cold water inlet tubes 34 and 36 fluidly couple hot and cold water sources (not shown) to the manual valve 30. Mixed water output from the valve 30 is illustratively supplied to a flexible outlet tube 38, which is fluidly coupled to the electrically operably valve 26. As may be appreciated, the valve 30 operates in a conventional manner wherein movement of the handle 32 may control temperature and/or flow rate of water delivered to the outlet tube 38.

The electrically operable valve 26 of the electronic faucet 10 may operate through the use of various sensing means, including infrared or capacitive sensing. In one illustrative embodiment, the electronic faucet 10 may operate through the use of capacitive sensing, for example, in the manner described in any one of the following U.S. patents, all of which are hereby incorporated by reference in their entireties: U.S. Pat. No. 6,962,168 to McDaniel et al., entitled "CAPACITIVE TOUCH ON/OFF CONTROL FOR AN AUTOMATIC RESIDENTIAL FAUCET", issued Nov. 8, 2005; U.S. Pat. No. 7,150,293 to Jonte, entitled "MULTI-MODE HANDS FREE AUTOMATIC FAUCET", issued Dec. 16, 2006; and U.S. Pat. No. 7,690,395 to Jonte et al., entitled "MULTI-MODE HANDS FREE AUTOMATIC FAUCET", issued Apr. 6, 2010.

In an illustrative embodiment, the controller 28 may be in communication with a sensing device 40 of the faucet 10. As detailed above, the sensing device 40 include a capacitive sensor. More particularly, the sensing device 40 may be capacitively coupled to selected electrically conductive faucet components, such as the hub 14, the delivery spout 12, the spray head 16, and/or the handle 32. Indicators, such as a audible speaker (not shown) or a light emitter 42, may also be in electrical communication with the controller 28, illustratively through an electrical connecting wire 44. A first end of connecting wire 44 may include a conventional electrical coupler 45 for coupling with the controller 28, while a second end of connecting wire 44 may be coupled to light emitter 42.

The hub 14 illustratively includes an outer wall or shell 46 formed of an electrically conductive material, such as brass or zinc with a chrome plated finish. The spout 12 and the spray head 16 may each similarly include an outer wall or shell 48 and 50 formed of electrically conductive material, such as brass or zinc with a chrome plated finish.

Figure 3:
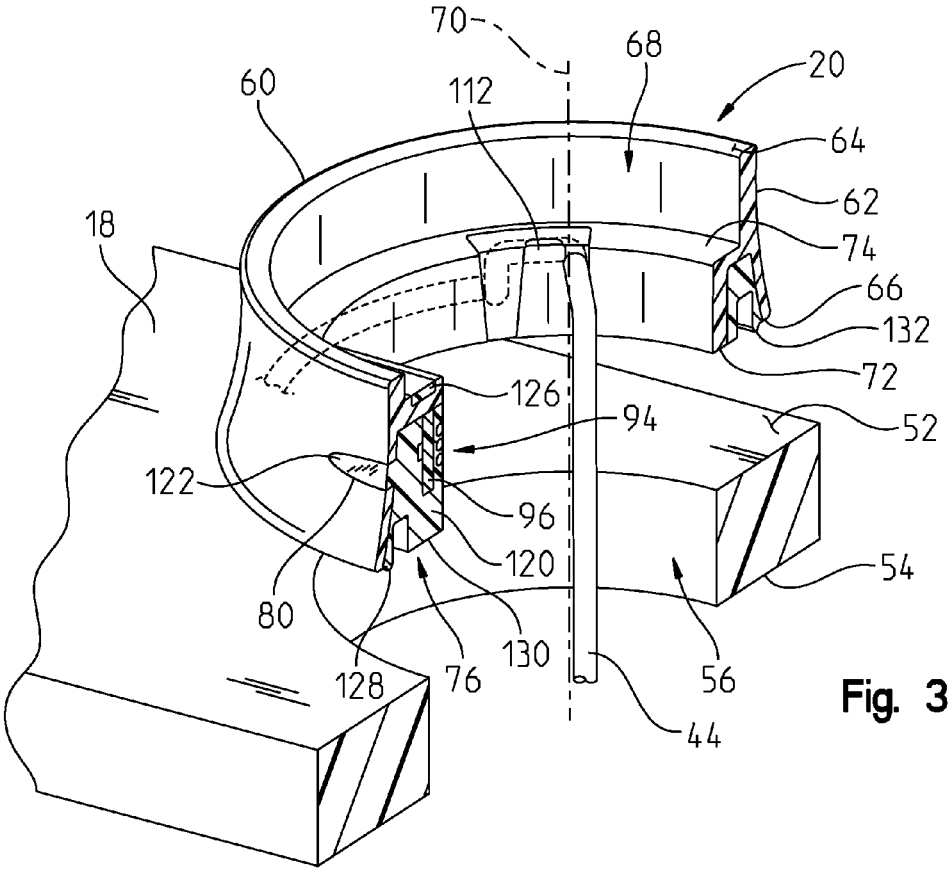
FIG. 3 is a perspective cross-sectional view taken along line 3-3 of FIG. 2, showing the insulator base above a mounting deck.
Figure 4:
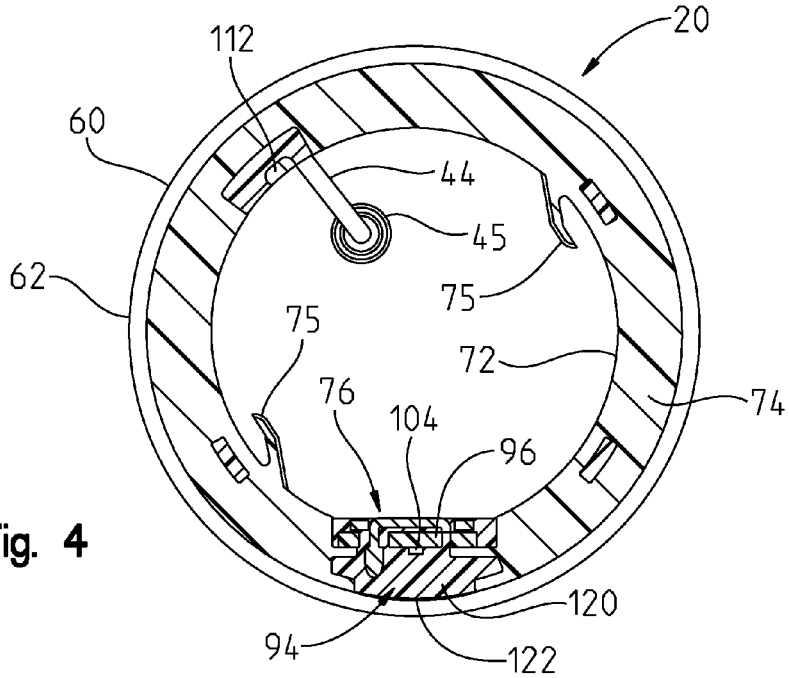
FIG. 4 is a cross-sectional view taken along line 4-4 of FIG. 2.

With reference to FIGS. 1 and 3, the sink deck 18 illustratively includes a top surface 52, an underside or a bottom surface 54, and a sink deck aperture 56 extending between the top surface 52 and the bottom surface 54 of the sink deck 18. The sink deck 18 may comprise any conventional mounting deck, for example, relatively thick (approximately 0.5 inches thick) cast iron/enamel sink deck, or a relatively thin (approximately 0.031 inches thick) stainless steel sink deck.

With reference to FIGS. 2-5, the insulator base 20 is supported on the top surface 52 of the sink deck 18 and electrically insulates the hub 14, the delivery spout 12, the spray head 16, and the handle 32 from the sink deck 18 to facilitate proper operation of the capacitive sensing device 40. In the illustrative embodiment, the insulator base 20 includes a housing 60 having an outer sidewall 62 extending between an upper surface 64 and a lower surface 66 and around a center opening 68 defining a longitudinal axis 70. An inner sidewall 72 may be formed concentrically within the outer sidewall 62 and connected thereto through a ledge or shoulder 74. The housing 60 is illustratively molded from a polymer, such as an acetal copolymer or polyoxymethylene (POM). The hub 14 is configured to interface with the upper surface 64 of the outer sidewall 62 and the ledge 74 of the insulator base 20. A pair of retaining clips 75 extend inwardly from the inner sidewall 72 and are configured to cooperate with the mounting anchor (not shown) securing the faucet 10 to the sink deck 18. Water conduit 22 extends through opening 68 of insulator base 20, and into hub 14 and delivery spout 12 (FIG. 1).

Figure 5:
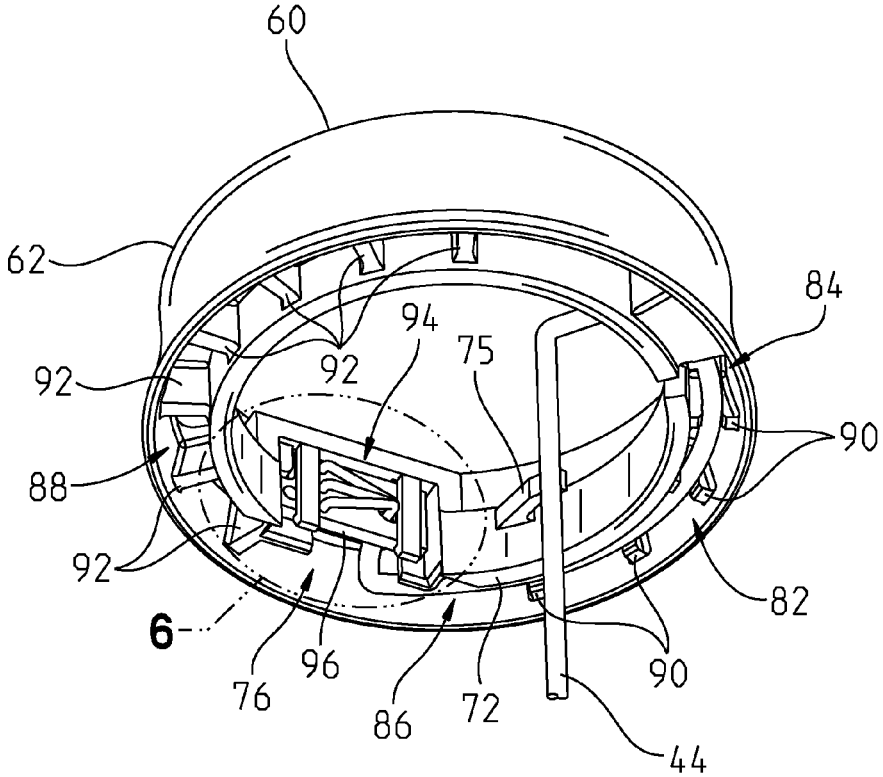
FIG. 5 is a bottom perspective view of the insulator base of FIG. 2, with the overmold removed therefrom for clarity.
Figure 6:
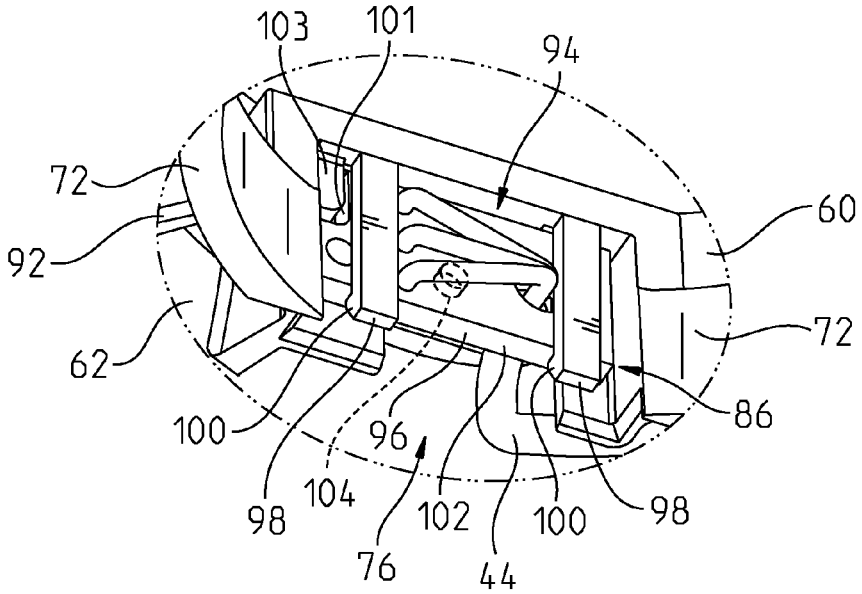
FIG. 6 is a detail view of FIG. 5.
Figure 7:
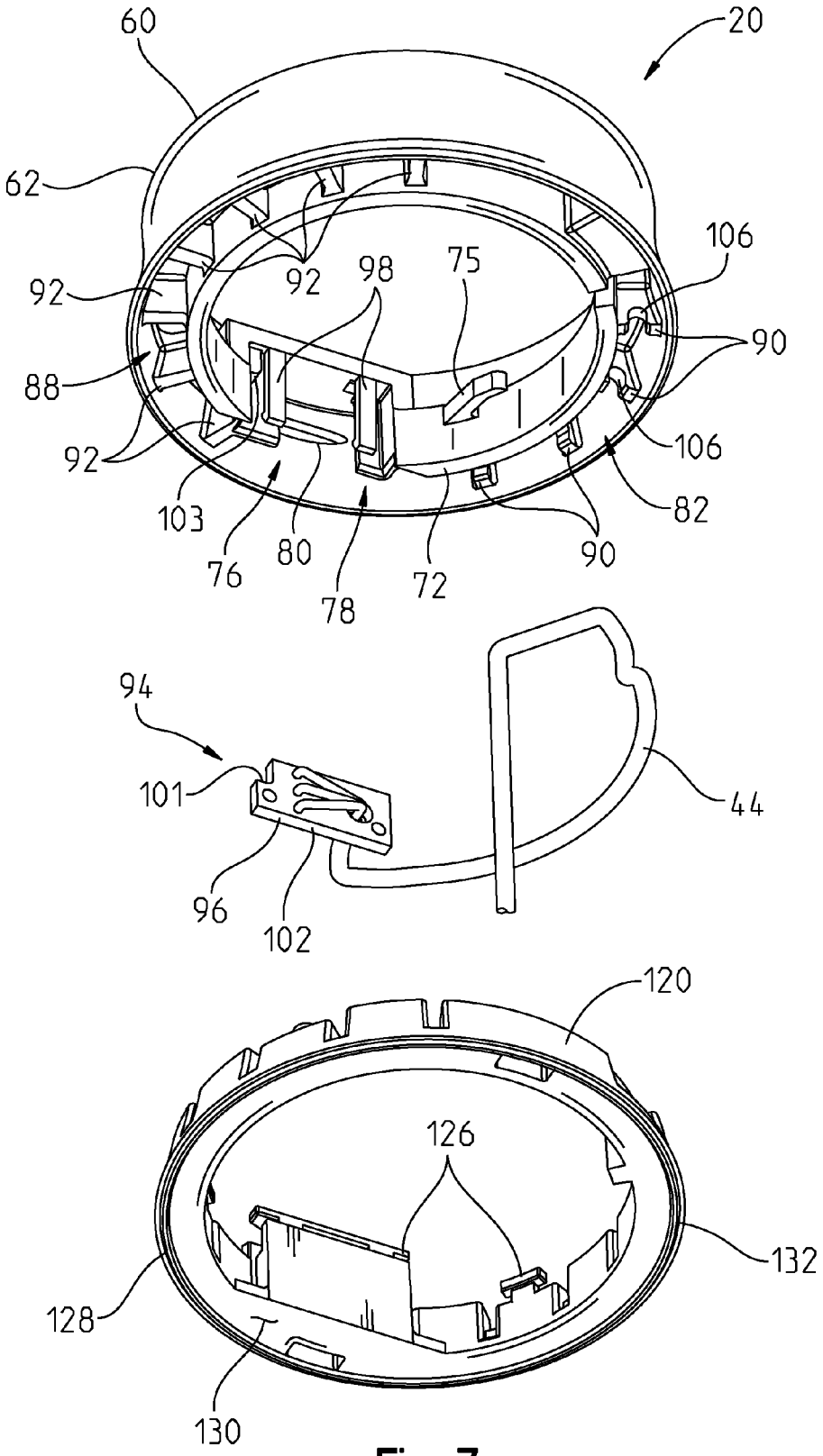
FIG. 7 is a bottom exploded perspective view of the insulator base of FIG. 2.

With reference to FIGS. 3, 5, and 7, the housing 60 defines a receiving chamber 76 positioned inwardly from the outer sidewall 62 adjacent a gap 78 (FIG. 7) within the inner sidewall 72. The receiving chamber 76 is aligned with an aperture 80 formed within the outer sidewall 62. A first channel 82 is positioned inwardly from the outer sidewall 62 and is in communication with the receiving chamber 76. More particularly, the first channel 82 extends arcuately between the outer sidewall 62 and the inner sidewall 72 from a first end 84 to a second end 86 (FIG. 5). A second channel 88 extends arcuately between the outer sidewall 62 and the inner sidewall 72 and is generally diametrically opposed to the first channel 82. A plurality of strengthening ribs 90 and 92 extend within the channels 82 and 88 between respective portions of the outer sidewall 62 and the inner sidewall 72.

A light assembly 94 is illustratively received within the chamber 76. The light assembly 94 illustratively includes a support board 96 retained in position by a pair of resilient latching members 98 extending downwardly from an upper portion of the housing 60. More particularly, the latching members 98 include clips 100 to secure a lower edge 102 of the support board 96. The support board 96 illustratively includes an orientation notch 101 configured to receive a protrusion 103 defined by housing 60. A light emitter 104, illustratively a light emitting diode (LED), is supported by the support board 96 and is electrically coupled to the connecting wire 44. The connecting wire 44 illustratively passes through the first channel 82 and into the receiving chamber 76 to provide electrical communication between the controller 28 and the light emitter 42.

With reference to FIGS. 5 and 7, a plurality of retaining brackets 106 are supported by the ribs 90 positioned within the first channel 82. More particularly, each rib 90 illustratively supports a retaining bracket 106 configured to received and frictionally retain the connecting wire 44. A holding tab 112 is operably coupled to the connecting wire 44 proximate the first end 84 of the channel 82, and the receiving chamber 76 is in communication with the second end 86 of the channel 82. In the illustrative embodiment, the connecting wire 44 extends angularly within the channel 82 by more than 90° and, more particularly, by approximately 135°.

Figure 8:
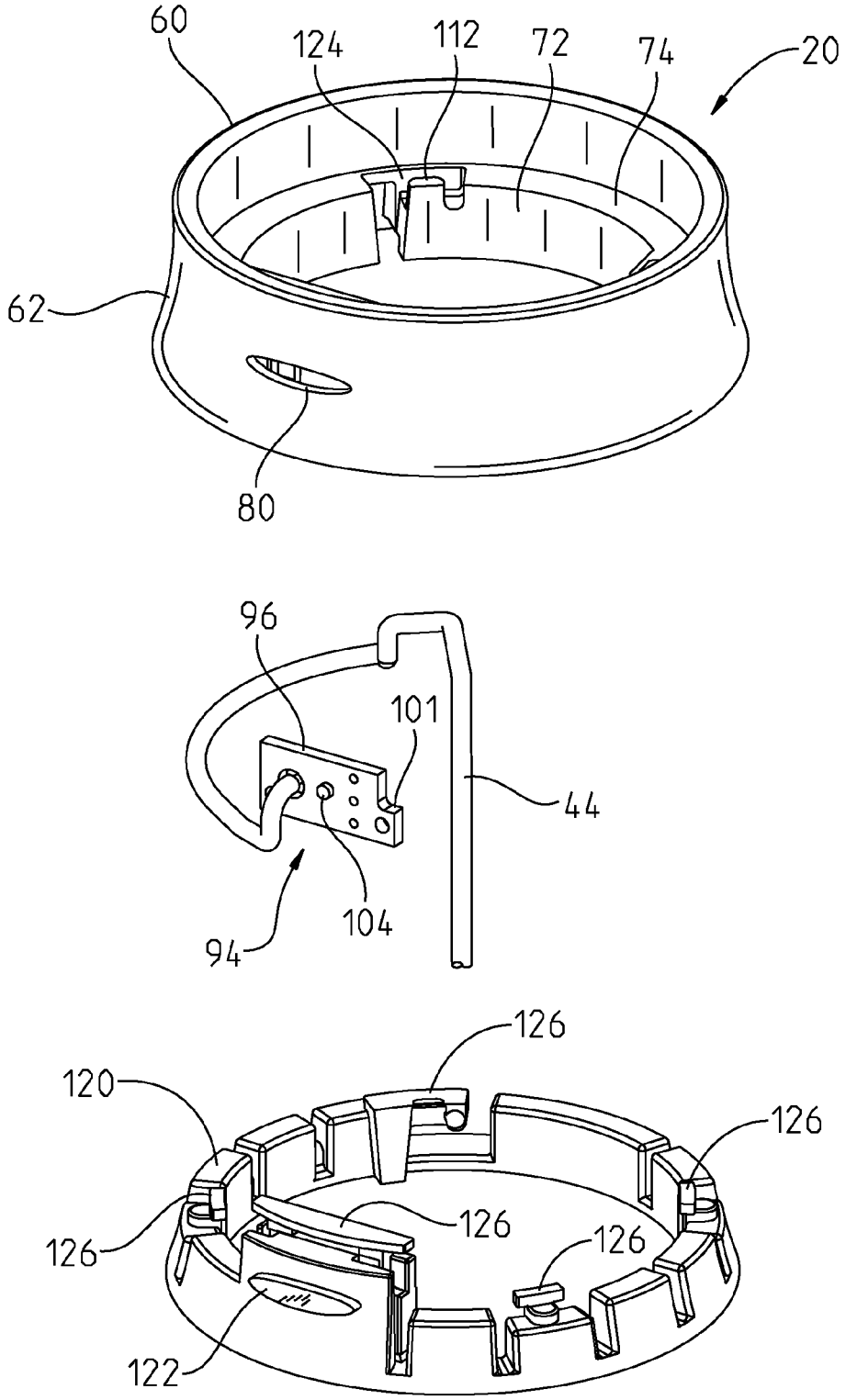
FIG. 8 is a top exploded perspective view of the insulator base of FIG. 2.
Figure 9:
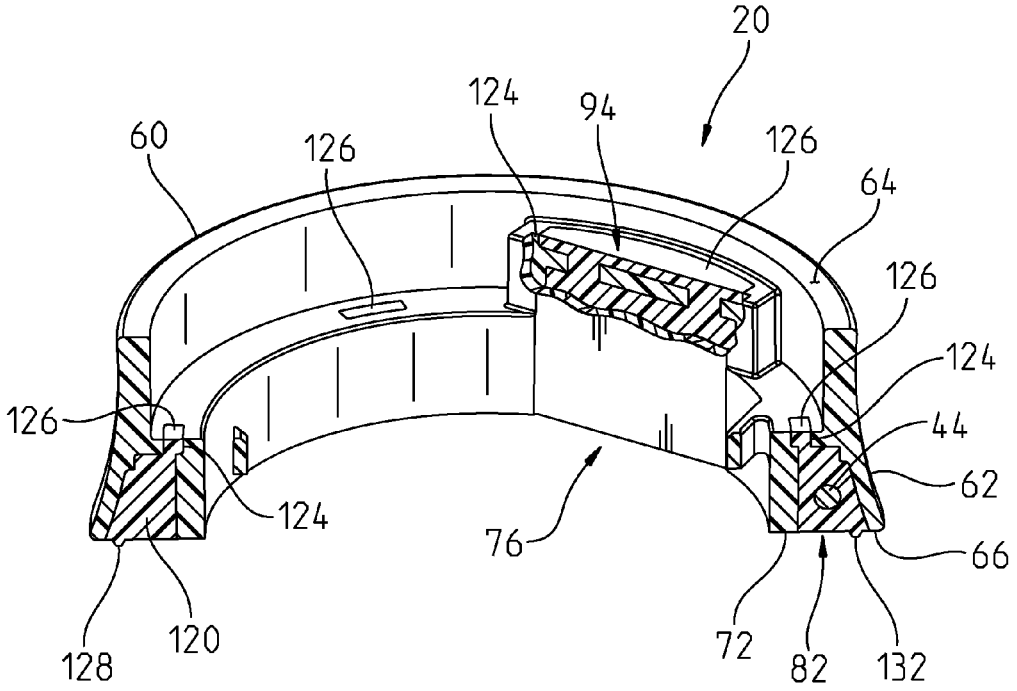
FIG. 9 is a cross-sectional view, with a partial cutaway thereof, of the insulator base of FIG. 2.

With reference to FIGS. 7-9, a polymer overmold 120 is coupled to the housing 60 and secures the connecting wire 44 within the first channel 82, encapsulates the light assembly 94 within the chamber 76, and defines a lens 122 within the aperture 80 of the outer sidewall 62. The lens 122 is configured to permit the transmission of light from the light emitter 104 therethrough. The overmold 120 is illustratively formed of a translucent or transparent low density polyethylene (LDPE).

Referring further to FIGS. 7-9, the overmold 120 is insert molded within cavities (e.g., receiving chamber 76, channels 82, 88) of the housing 60. In other words, the housing 60 essentially forms a die for receiving the molten material of the overmold 120. A plurality of reentrant locking chambers 124 are defined by the housing 60 and into which the molten material of the overmold 120 flows. As a result, the overmold 120 includes retaining members 126 that are secured within the locking chambers 124 and help secure the overmold 120 to the housing 60.

With reference to FIGS. 3 and 7, a sealing member 128 is integrally formed within the lower surface 130 of the overmold 120 for sealing with the top surface 52 of the mounting deck 18. The sealing member 128 illustratively includes an annular gasket 132 integrally molded within, and extending downwardly from, the overmold 120.

A method of manufacturing the insulator base 20 for electronic faucet 10 illustratively includes the steps of molding housing 60, illustratively through a conventional injection molding process using an acetal copolymer. Light assembly 94 is then placed within the chamber 76 of the housing 60, wherein support board 96 of the light assembly 94 is initially retained through the resilient latching members 98. The connecting wire 44 connected to the light assembly 94 is then fed from the chamber 76 through the channel 82 and is initially retained in place by retaining brackets 106. Next, a polymer, illustratively a low density polyethylene, is insert molded within the housing 60, including channels 82, 88 and chamber 76 of the housing 60. The overmold 120 encapsulates the light assembly 94 and retains the connecting wire 44 within the housing 60. Simultaneously, lens 122 is formed within the opening 80 of the housing 60. Also simultaneously, downwardly extending sealing member 128 is formed in the lower surface 130 of the overmold 120.

Although the invention has been described in detail with reference to certain preferred embodiments, variations and modifications exist within the spirit and scope of the invention as described and defined in the following claims.

The invention claimed is:

1. An insulator base for an electronic faucet, the insulator base comprising:

a housing including an outer sidewall and an inner sidewall each extending about an opening defining a longitudinal axis, a receiving chamber positioned inwardly from the outer sidewall, a channel positioned inwardly from the outer sidewall and in communication with the receiving chamber, the channel defined between the outer sidewall and the inner sidewall, and an aperture formed within the outer sidewall and in communication with the receiving chamber;

a light assembly including a support board and a light emitter coupled to the support board, the support board positioned within the receiving chamber of the housing;

a connecting wire electrically coupled to the light assembly, the connecting wire extending within the channel of the housing and into the receiving chamber; and a polymer overmold coupled to the housing, encapsulating and securing the light assembly within the receiving chamber and the connecting wire within the channel, the overmold defining a lens within the aperture of the outer sidewall, the lens permitting the transmission of light from the light emitter therethrough.

2. The insulator base of claim 1, wherein a plurality of retaining brackets are positioned within the channel for coupling to the connecting wire.

3. The insulator base of claim 1, wherein the housing is formed of an acetal copolymer, and the overmold is formed of a low density polyethylene.

4. The insulator base of claim 1, further comprising a downwardly extending sealing member integrally formed within a lower surface of the overmold for sealing with a mounting deck.

5. The insulator base of claim 1, wherein the housing further includes a latching member extending within the receiving chamber and configured to couple to a lower end of the support board of the light assembly.

6. The insulator base of claim 1, wherein the housing includes an upper end configured to be positioned below a delivery spout, a lower end configured to be positioned above a mounting deck, and the opening configured to receive a water conduit extending into the delivery spout.

7. The insulator base of claim 1, wherein the channel of the housing includes a first end and a second end, the housing including a holding tab operably coupled to the connecting wire at the first end, and the second end is in communication with the chamber.

8. The insulator base of claim 1, wherein the overmold encapsulates the light assembly to prevent contact from water.

9. An insulator base for an electronic faucet, the insulator base comprising:

a housing including an outer sidewall, an inner sidewall, a channel defined between the outer sidewall and the inner sidewall, a receiving chamber positioned adjacent the channel, and an aperture formed within the outer sidewall and in communication with the receiving chamber;

a light assembly including a support board and a light emitter coupled to the board, the support board received within the receiving chamber of the housing;

a connecting wire electrically coupled to the light assembly, the connecting wire extending within the channel of the housing; and a polymer overmold coupled to the housing, the overmold securing the connecting wire within the channel, encapsulating the light assembly within the chamber, defining a lens within the aperture of the outer sidewall, the lens permitting the transmission of light from the light emitter therethrough, and defining a downwardly extending sealing member for sealing with a mounting deck.

10. The insulator base of claim 9, wherein a plurality of retaining brackets are positioned within the channel for coupling to the connecting wire.

11. The insulator base of claim 9, wherein the housing is formed of an acetal copolymer, and the overmold is formed of a low density polyethylene.

12. The insulator base of claim 9, wherein the housing further includes a latching member extending within the receiving chamber and configured to couple to a lower end of the support board of the light assembly.

13. The insulator base of claim 9, wherein the housing includes an upper end configured to be positioned below a delivery spout, a lower end configured to be positioned above a mounting deck, and the opening configured to receive a water conduit extending into delivery spout.

14. The insulator base of claim 9, wherein the channel of the housing includes a first end and a second end, the housing including a holding tab operably coupled to the connecting wire at the first end, and the second end is in communication with the chamber.

15. An electronic faucet comprising:

a delivery spout;

a water conduit extending within the delivery spout and including a water outlet;

a base positioned intermediate the delivery spout and a mounting deck, the base including a housing defining an opening receiving the water conduit, the base further including an outer sidewall, an inner sidewall spaced apart from the outer sidewall, a channel defined between the inner sidewall and the outer sidewall, a receiving chamber positioned adjacent the channel, an aperture formed within the outer sidewall and in communication with the receiving chamber, a light assembly supported by the housing and having a light emitter, and an overmold insert molded within the housing and encapsulating the light assembly within the chamber, the overmold defining a lens within the aperture of the outer sidewall, the lens permitting the transmission of light from the light emitter therethrough;

a controller operably coupled to the light assembly, the controller configured to control operation of the light emitter; and a connecting wire electrically coupling the controller and the light assembly, the connecting wire passing through the opening and below the mounting deck, wherein the channel is configured to receive the connecting wire.

16. The electronic faucet of claim 15, further comprising a sealing member integrally formed within a lower surface of the overmold for sealing with the mounting deck.

17. The electronic faucet of claim 15, wherein the light assembly includes a support board, and the base further includes a latching member extending within the receiving chamber and configured to couple to a lower end of the support board of the light assembly.

18. A method of manufacturing an insulator base for an electronic faucet, the method comprising the steps of:

molding a polymer housing including an outer sidewall, an inner sidewall, a channel defined between the outer sidewall and the inner sidewall, a receiving chamber positioned adjacent the channel, and an aperture formed within the outer sidewall and in communication with the receiving chamber;

placing a light assembly within the receiving chamber of the housing, the light assembly including a support board and a light emitter;

placing a connecting wire within the channel of the housing; and insert molding a polymer overmold within the receiving chamber of the housing and the channel of the housing, the overmold encapsulating the light assembly, defining a lens within the aperture of the outer sidewall, the lens configured to transmit light form the light emitter, the polymer overmold defining a downwardly extending sealing member for sealing with a mounting deck and retaining the connecting wire within the housing.

19. The method of claim 18, further comprising the step of retaining the light assembly by a resilient clip within the chamber of the housing prior to the insert molding step.

20. The method of claim 19, further comprising the step of retaining the wire within the channel by a plurality of brackets prior to the insert molding step.

21. The method of claim 18, wherein the insert molding step includes forming a downwardly extending sealing member in the lower surface of the overmold.

* * * * *

UNITED STATES PATENT AND TRADEMARK OFFICE

CERTIFICATE OF CORRECTION

PATENT NO. : 9,057,184 B2
APPLICATION NO. : 13/277000
DATED : June 16, 2015
INVENTOR(S) : Steven Kyle Meehan et al.

It is certified that error appears in the above-identified patent and that said Letters Patent is hereby corrected as shown below:

IN THE CLAIMS

In Claim 18, Column 8, line 17, please amend as follows:

--configured to transmit light from the light emitter, the--

Signed and Sealed this
First Day of March, 2016

Michelle K. Lee

Michelle K. Lee
*Director of the United States Patent and Trademark Office*